US008904939B2

(12) United States Patent
Constant et al.

(10) Patent No.: US 8,904,939 B2
(45) Date of Patent: Dec. 9, 2014

(54) AVALANCHE-INDUCING DEVICE

(75) Inventors: Stephane Constant, Saint Pierre d'allevard (FR); Philippe Berthet-Rambaud, Chateauneuf (FR); Pascal Roux, Le Sappey en Chartreux (FR)

(73) Assignee: Technologie Alpine de Securite—TAS (FR)

( * ) Notice: Subject to any disclaimer, the term of this patent is extended or adjusted under 35 U.S.C. 154(b) by 0 days.

(21) Appl. No.: 13/515,147

(22) PCT Filed: Nov. 30, 2010

(86) PCT No.: PCT/FR2010/052575

§ 371 (c)(1),
(2), (4) Date: Sep. 7, 2012

(87) PCT Pub. No.: WO2011/070268

PCT Pub. Date: Jun. 16, 2011

(65) Prior Publication Data

US 2012/0318159 A1 Dec. 20, 2012

(30) Foreign Application Priority Data

Dec. 10, 2009 (FR) ..... 09 58828

(51) Int. Cl.
*F42D 3/00* (2006.01)

(52) U.S. Cl.
CPC ..... *F42D 3/00* (2013.01)
USPC ..... 102/363; 102/302; 89/7

(58) Field of Classification Search
CPC ..... F42D 3/00
USPC ..... 102/301, 302, 363, 402, 403, 293; 89/7
See application file for complete search history.

(56) References Cited

U.S. PATENT DOCUMENTS 5,107,765 A * 4/1992 Schippers ..... 102/302
6,279,481 B1 * 8/2001 Schippers ..... 102/302

(Continued)

FOREIGN PATENT DOCUMENTS

| | | | |
|---|---|---|---|
| FR | 2636729 | A1 | 3/1990 |
| FR | 2765321 | A1 | 12/1998 |
| WO | 89/08234 | A1 | 9/1989 |
| WO | 2007/096524 | A1 | 8/2007 |
| WO | 2009/080977 | A2 | 7/2009 |

OTHER PUBLICATIONS

International Preliminary Report on Patentability and Written Opinion dated Jul. 4, 2012 re: PCT/FR2010/052575; p. 5; citing: FR2 765 321 A1.

(Continued)

*Primary Examiner* — James Bergin
(74) *Attorney, Agent, or Firm* — Cantor Colburn LLP

(57) ABSTRACT

Said device comprises a tube (1), one closed end of which is mounted onto a holder (5), for example a concrete mass (6), that is itself attached to a mountainside (7). The other open end (2) of said tube is rotated toward the snow cover (3). The device also comprises a means (8) for filling the tube (1) with an explosive gas mixture and moreover comprises a priming means that induces the explosion of said mixture. Said device is characterized in that it comprises at least two beams (9) that, each being attached by one of the ends thereof to the holder (5), extends along the tube (1) parallel thereto so as to ensure the holding thereof while forming a means for absorbing the movement of the tube (1) following the gas mixture explosion.

11 Claims, 4 Drawing Sheets

(56) References Cited

U.S. PATENT DOCUMENTS

| | | | | |
|---|---|---|---|---|
| 6,324,982 | B1 * | 12/2001 | Eybert-Berard et al. | 102/363 |
| 6,374,717 | B1 * | 4/2002 | Schippers | 89/7 |
| 7,707,938 | B2 * | 5/2010 | Hisel | 102/302 |
| 8,342,096 | B2 * | 1/2013 | Greipl | 102/363 |
| 8,430,032 | B2 * | 4/2013 | Farizy et al. | 102/363 |
| 2006/0254449 | A1 | 11/2006 | Hisel | |
| 2013/0133543 | A1 * | 5/2013 | Farizy et al. | 102/302 |

OTHER PUBLICATIONS

International Search Report issued Feb. 21, 2011 by European Patent Office re: PCT/FR2010/052575; pp. 2; citing: FR 2 765 321 A1, US 2006/254449 A1, FR 2 636 729 A1 and WO 89/08234 A1.

Written Opinion issued Feb. 21, 2011 by European Patent Office re: PCT/FR2010/052575 p. 1-4; citing FR 2 765 321 A1.

* cited by examiner

AVALANCHE-INDUCING DEVICE

TECHNICAL FIELD

The present invention concerns a device for inducing avalanches and in particular snow avalanches.

Said device is used for the preventive triggering of avalanches in places where the accumulation of snow could lead to risks of major avalanches jeopardizing persons or property, having regard in particular to the existence of transport infrastructures, ski slopes or inhabited areas.

BRIEF DESCRIPTION OF RELATED ART

Devices and techniques for deliberately inducing avalanches are already known.

One first technique consists of having explosive charges deposited by an operator at the precise location where it is desired to induce the avalanche. This deposit can be made either by dropping from a helicopter, or on the ground, the charge then possibly being dropped onto or placed at the suitable spot. The primer of the charge in both cases is generally obtained by a slow fuse or electrically.

The risks inherent in this technique are high. In addition to the risks directly related to the handling of explosives, for on-site depositing the operator must reach often steep slopes having an unstable snow covering. These operations, whether performed on the ground or from a helicopter, must also sometimes take place under difficult weather conditions.

To reduce these risks related to having to approach the firing area, remote triggering techniques have been introduced.

Remote triggering techniques use military weapons such as rocket launchers or howitzers to cause the explosion on site. This type of device does not meet all laws and regulations such as French legislation which prohibits the storing of primed explosive charges.

The device known under the trade name CATEX uses a transporter cable system of explosives which passes above one or more avalanche corridors. While this type of solution allows limiting of the risks related to travelling to the site of where the avalanche is to be induced, it does not bring any solution regarding the handling and storage of explosives. In addition, this device requires the costly installation of a system of pylons to carry the transporter cable over distances which may be very long.

One way to reduce the risks related to the handling of explosives is the use of explosive gases for generating a shock wave to trigger the avalanche.

Along this principle, transportable devices are known which can be brought on site by helicopter hoisting. These devices described in documents WO 2007/096524 and WO 2009/080977 both use a mixture of explosive gases to trigger an explosion above the snow mantle. These devices have the main advantage of being able to be used over areas that are not previously equipped and without any handling of explosives. The disadvantages remain those inherent in the use of a helicopter, namely the operating costs which remain high and the impossibility to operate in bad weather.

Another type of device is the one known under the name GAZEX. This type of device described in document FR 2 636 729, comprises an exploder tube with a closed bottom part mounted on a concrete support and whose opening is directed in the direction of the snow mantle. The angle and the holding in position of the tube are obtained by means of two carrier feet. These two feet, depending on whether the device is of static or inertia type are either secured to an anchoring block or are provided with a counter-weight which rests on a concrete platform. A gas circuit is used to fill the exploder tube with oxidizer gas and fuel gas that are ignited by an ignition device advantageously mounted at the rear of the exploder tube. The blast of the resulting explosion is then directed via the tube opening in the direction of the snow mantle thereby triggering the avalanche. This type of device comprises a sufficient gas reserve for a season and a remote-controlled firing system which, among other advantages, provide full autonomy and perfect operator safety. The fixed installation of this device also allows guaranteed, sufficient long-term power for the protection of large-size avalanche corridors. The main disadvantage with this type of device is the installation cost related to the construction of the support to secure the base of the cannon to the anchoring block or concrete platform, depending on the type of device used to secure the carrier feet.

BRIEF SUMMARY

To overcome the afore-mentioned shortcomings, the invention concerns a device for inducing avalanches comprising a tube of which one closed end is mounted on a support itself secured to the mountainside, for example on a concrete block, and whose other open end is directed towards the snow mantle, the device further comprising means for filling the tube with an explosive gas mixture and priming means for triggering the explosion of the said mixture, characterized in that it comprises at least two beams each secured by one of their ends to the support and which extend along the tube parallel thereto ensuring the support thereof whilst forming means for damping the movement of the tube subsequent to explosion of the gas mixture.

Therefore the beams supporting the exploder tube advantageously do away with the need for carrier feet and hence all the devices such as anchoring blocks needed for their support, thereby reducing the installation cost of this device. The invention, through the damping means offered by the beams, additionally allows a reduction in the stresses transmitted to the support each time an avalanche is induced, thereby providing the device with durability.

According to one possibility of the invention, the beams are arranged parallel either side of the tube.

With said arrangement, it is possible to distribute stresses symmetrically at the time of inducing an avalanche and to limit the lateral movements of the exploder tube and hence the forces applied to the securing means between the tube and the support.

Preferably the beams are secured to one another.

This securing produces a better distribution of forces during the movement generated by the explosion inside the exploder tube, and thereby allows a reduction in the forces exerted at the time of inducing an avalanche on the means securing the exploder tube onto the support.

Advantageously, the beams are solid and of rectangular cross-section with their length, as seen in cross-section, lying vertically and the width horizontally.

The choice of this shape allows a better distribution of thrust forces. Since the explosion within the tube, through the principle of the invention, has a tendency to create a vertical thrust, the beams offer greater resistance in this direction.

Preferably the ratio between the length and width is of the order of four.

According to one of the characteristics of the invention, each beam is made from material having a Young's modulus within the range of 60 GPa to 250 GPa, preferably of the order of 150 GPa to 200 GPa, and having preserved resilience at temperatures between +40° C. and −40° C.

In this manner, each beam is able to deform so as to accompany and damp the movement of the exploder tube in relation to the support, under the extreme operating temperature conditions of the device.

According to one of the characteristics of the invention, each beam is made from steel with high yield strength.

The use of steel having high yield strength offers the qualities of both solidity and elasticity that are required to guarantee damping of the movements of the exploder tube after the inducing of an avalanche.

According to one embodiment of the device, each beam is formed of a plurality of elements secured to each other.

The use of several elements, for a given damping effect, allows the weight of the device to be reduced.

Advantageously, the tube is mounted hinged on its bottom side over a horizontal axis perpendicular to the axis of the tube, whilst its front part is mounted by means of a mobile connection close to the front ends of the beams.

Therefore the mounting of the exploder tube on the support does not hinder the movement of the tube when an avalanche is induced, and therefore enables the beams to ensure their damping function. The mobile mounting between the beams and the tube prevents the supporting function of the beams from hindering their damping function.

According to one characteristic of the invention each beam, in the vicinity of its free end, comprises a finger which is positioned facing the other beam and is intended to be engaged in a clevis secured to the tube, whose opening is directed towards the bottom side of the tube.

In this manner, the finger present on the beams, sliding in the clevis secured to the tube, ensures freedom of movement along the longitudinal axis of the beams whilst guaranteeing their tube-supporting function.

According to one embodiment of the device, the tube has a cross-section which varies over its length, the cross-section in the opening portion being smaller than the cross-section in the bottom portion of the tube.

This shape offers a blast confinement function of the explosion, thereby providing a greater thrust on the snow mantle and hence optimized triggering of an avalanche.

The cross-section of the tube may be circular or other e.g. elliptical.

BRIEF DESCRIPTION OF THE DRAWINGS

The invention will be better understood with the help of the following description and with reference to the appended schematic drawings which illustrate a non-limiting example of embodiment of this avalanche-inducing device.

DETAILED DESCRIPTION

Figure 1:
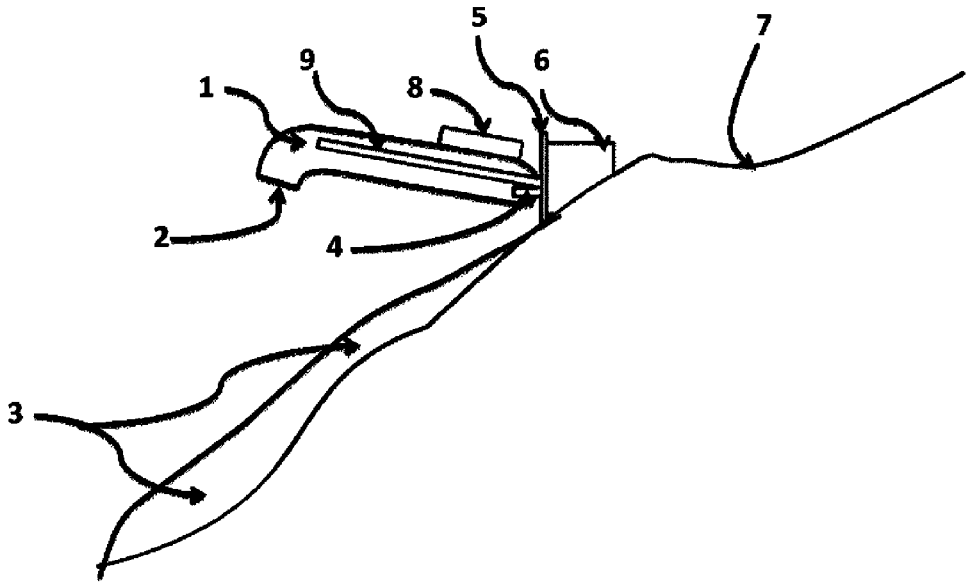
FIG. 1 is a schematic side view thereof on site.

The device illustrated in FIG. 1 comprises an exploder tube 1 with closed bottom whose opening 2 is directed towards a snow mantle 3. This tube 1 comprises means 4 for mounting on a support 5 secured via a concrete block 6 on the mountainside 7. The device also comprises means for filling the tube with an explosive gas mixture 8, this mixture being used to form the explosion intended to trigger the avalanche. The device also comprises beams 9 connected to the support 5 and supporting the exploder tube 1.

The device thus formed uses the following operating principle. When an avalanche is induced by an operator, the exploder tube 1 is filled with an explosive gas mixture composed of a well-defined combination of oxidizer and fuel gas from the filling means 8. Priming means, not illustrated here, allow the triggering of the explosion of the said mixture. The blast of the resulting explosion is directed via the opening 2 of the tube 1 towards the snow mantle 3 which, on account of its instability, is separated from the mountainside 7 thereby triggering an avalanche. During this operation, the blast of the explosion will transmit a horizontal force to the tube 1. This force generates movement of the tube 1 which is advantageously damped by the beams 9 thereby limiting the forces transmitted to the support 5.

Figure 2:
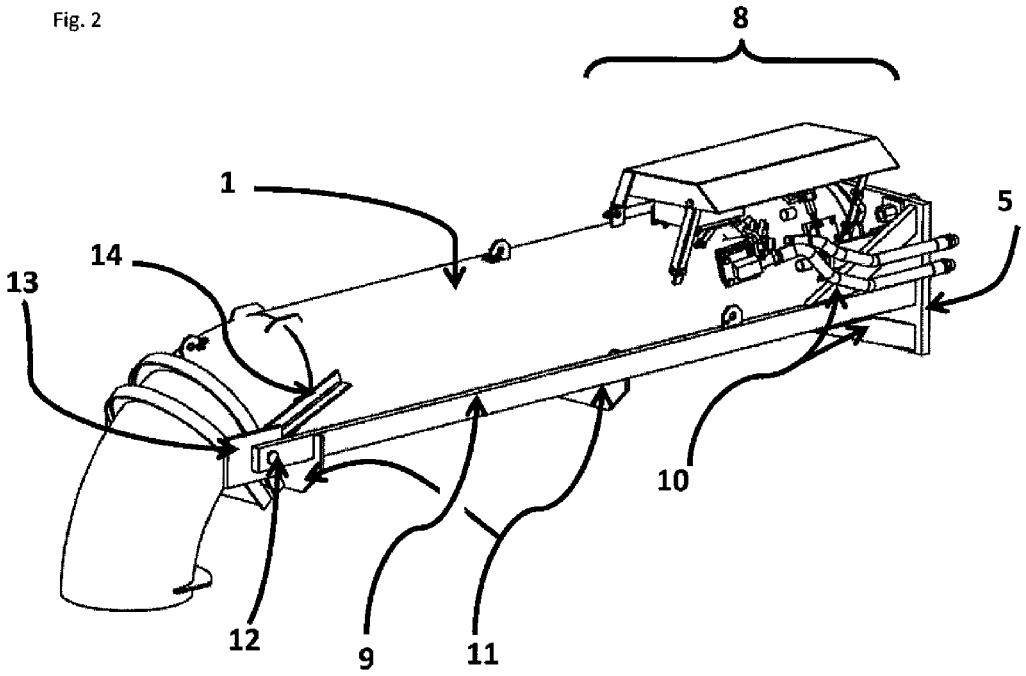
FIG. 2 is a perspective view.
Figure 3:
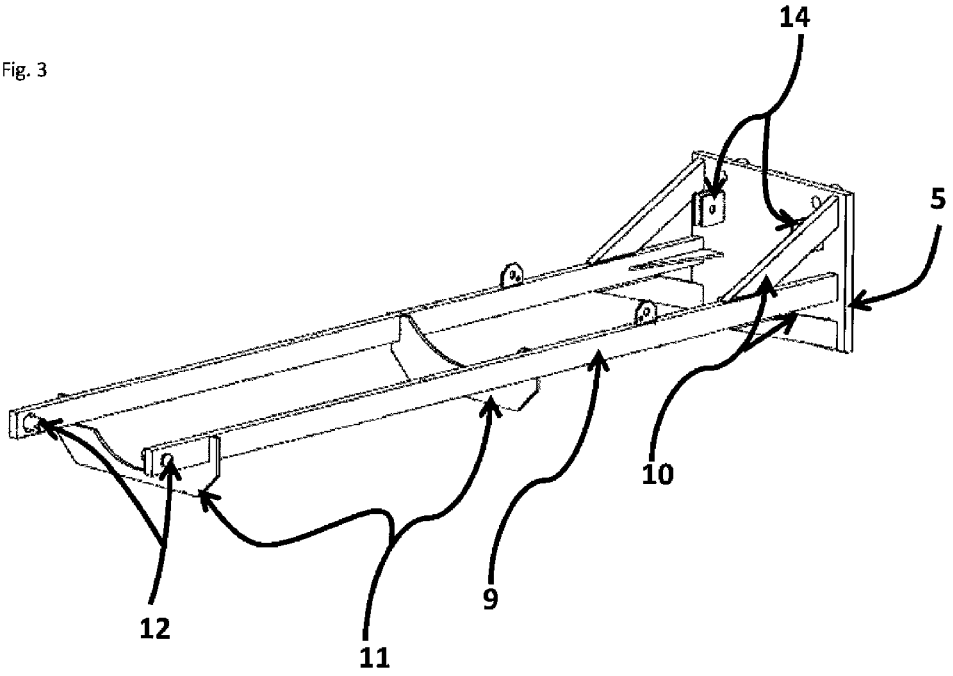
FIG. 3 is a perspective view of the support of the device.

One embodiment of this device is illustrated in FIGS. 2 to 4.

In this embodiment, as illustrated in FIG. 2, the device comprises an exploder tube 1 hinge-mounted on a support 5 mounted fixedly on a concrete block 6. This mounting is obtained by means of two bearings 14 on the support within which there slide two other bearings, not illustrated here, present at the rear of the tube 1. These different bearings are associated by means of pivots, not illustrated, along a horizontal axis perpendicular to the axis of the tube 1. The mounting thus obtained allows a rotational movement towards the top of the tube 1 relative to the support 5. Two beams 9 in high yield strength steel are fixed to the support either side of the tube 1. The fixing of these two beams is consolidated by means of lateral reinforcements 10. They are also secured laterally obtained by means of cradle-shaped metal plates 11 so as not to hamper the tube. In addition, the two beams 9 at their free end also have a finger 12 directed facing the other beam. This finger 12 is intended to engage in a longitudinal runner 13 secured to the tube 1 and oriented substantially parallel to the tube. The mounting thus obtained allows free movement of the tube 1 in the horizontal direction relative to the beams 9 whilst ensuring vertical support via the beams 9. The embodiment also has a metal angle 14 facilitating the installation of the tube 1 on the beams 9 offering guidance for the fingers 12 when they are inserted in the parts 13.

Figure 4A:
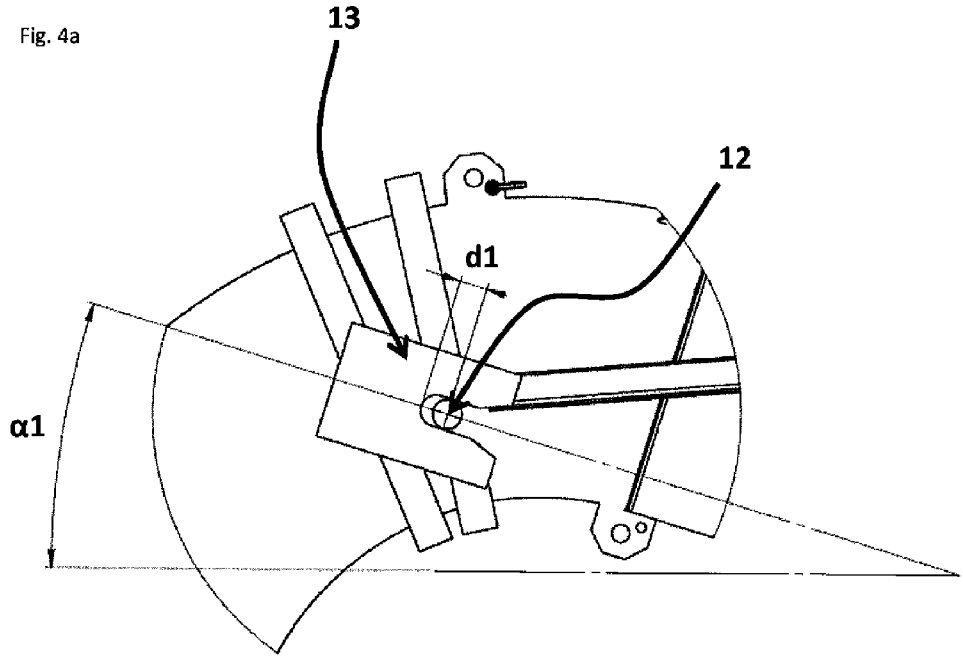
FIGS. 4*a* and 4*b* show side views of the mobile mounting between the exploder tube and the supporting beams, respectively at rest and with maximum movement of the tube.
Figure 4B:
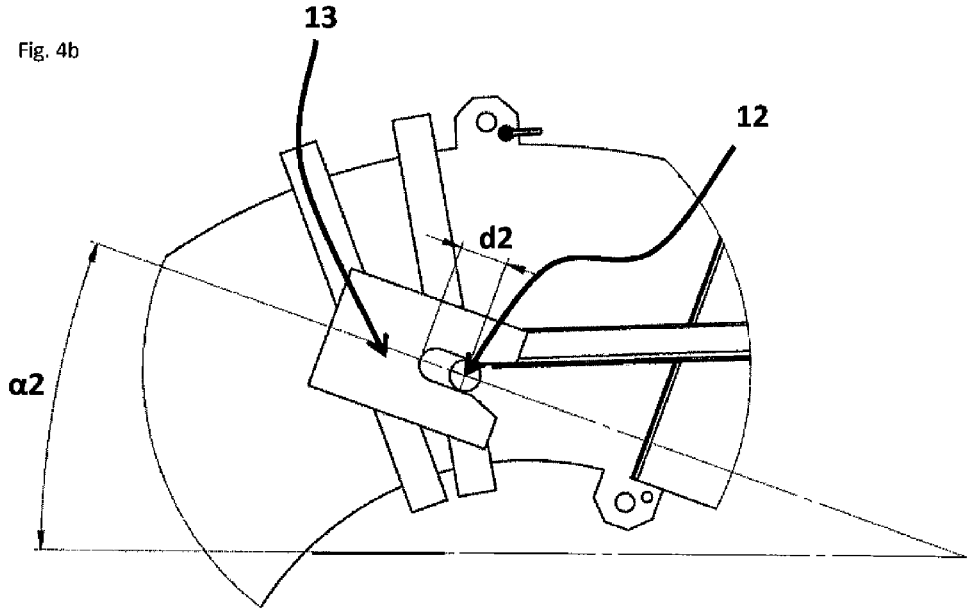

The functioning of the device thus formed is the following. When an explosion is triggered, the force generated by the blast of the explosion generates a rotational movement towards the top of the tube 1 relative to the support 5. This rotational movement of the tube 1 is limited and damped by the beams 9. During the rotation of the tube 1, the engaging of the fingers 12 by the parts 13 generates upward movement of the fingers 12. This movement thereby carries with it the end of the beams 9 having the said fingers 12. This produces deflection of the beams 9 allowed by the choice of their constituent material, namely a steel having high yield strength. This deformation of the beams 9 then generates return forces whose effect is to dissipate part of the energy transmitted to the exploder tube 1 at the time of the explosion. This dissipation of energy is made possible by the free horizontal movement of the tube 1 relative to the beams 9 which allows the optimized transfer of the return forces in the vertical direction and hence a reduction in the movement of the tube 1 as illustrated in FIGS. 4*a* and 4*b*. Therefore the angle of the tube 1 relative to the horizontal, in this example, is limited changing from a value $\alpha 1$ at rest of 17° to a value $\alpha 2$ of 19.5° at maximum rotation. The horizontal movement of the devises 13 relative to the fingers 12 also remains contained, varying from the value d1 of about 5 cm at rest to the value d2 in the region of 8 cm at maximum movement. It is this free horizontal movement of the tube 1 relative to the beams 9 which allows the optimized transfer of return forces in the vertical direction, thereby ensuring damping of the movement of the tube. This damping therefore leads to rapid re-initialization of the device which, by re-assuming its configuration at rest, offers the possibility of a second firing operation for inducing an avalanche.

The invention is evidently not limited to the embodiments described above. In particular, it can use a plurality of beams to ensure the optimized damping of movements of the exploder tube, or it may use beams in composite material such as carbon fiber for example. In addition, the mobile connection means between the front end of the tube and the beams could be reversed, each beam in the vicinity of its free end comprising a longitudinal runner engaging a finger secured to the tube.

The invention claimed is:

1. An avalanche inducing device, comprising:

a tube of which one closed end is mounted on a support itself secured to a mountainside on a concrete block and whose other open end is directed towards a snow mantle;

means for filling the tube with an explosive gas mixture;

priming means triggering an explosion of the said mixture, and at least two beams which, each secured via one of its ends to the support, extend along the tube parallel thereto to ensure the supporting thereof, whilst forming means for damping the movement of the tube subsequent to explosion of the gas mixture.

2. The device according to claim 1 wherein the beams are arranged parallel either side of the tube.

3. The device according to claim 2, wherein the beams are secured to one another.

4. The device according to claim 1 wherein the beams are solid and of rectangular cross-section with, as seen in cross-section, a length lying vertically and a width horizontally.

5. The device according to claim 4, a ratio between the length and the width is of the order of four.

6. The device according to claim 1, wherein each beam is made from material having a Young's modulus in the range of 60 GPa to 250 GPa and having preserved resilience at temperatures between +40° C. and −40° C.

7. The device according to claim 1 wherein each beam is made from steel with high yield strength.

8. The device according to claim 1 wherein each beam is formed of a plurality of elements secured to each other.

9. The device according to claim 1 wherein the tube is hinge-mounted on the bottom side over a horizontal axis perpendicular to the axis of the tube, whilst its front part is mounted via mobile connection means in the vicinity of the front ends of the beams.

10. The device according to claim 9 wherein the mobile connection between the tube and the beams comprises two fingers engaged in two longitudinal runners.

11. The device according to claim 1 wherein the tube has a cross-section which varies over its length, the cross-section in the opening portion being smaller than the cross-section in the bottom portion of the tube.

* * * * *